United States Patent [19]

D'Amato

[11] Patent Number: 4,667,409

[45] Date of Patent: May 26, 1987

[54] WALLPAPER TRIMMER

[76] Inventor: Peter D'Amato, 46 Shropshire Dr., Scarborough, Ontario, Canada, M1P 1Y9

[21] Appl. No.: 905,425

[22] Filed: Sep. 10, 1986

[51] Int. Cl.[4] ..... B26B 29/00

[52] U.S. Cl. ..... 30/289; 30/287; 30/294

[58] Field of Search .....30/289, 294, 287, 2, 30/292, 339

[56] References Cited

U.S. PATENT DOCUMENTS

| | | | |
|---|---|---|---|
| 34,421 | 2/1862 | Gould | 30/287 |
| 1,908,851 | 5/1933 | Lafever et al. | 30/289 |
| 2,291,075 | 7/1942 | Hanson | 30/294 |
| 2,473,551 | 6/1949 | Stanley | 30/294 |
| 2,573,381 | 10/1951 | Arnold | 30/289 X |
| 2,889,623 | 6/1959 | Baker | 30/294 |
| 3,509,633 | 5/1970 | Fernandes | 30/289 |
| 3,732,619 | 5/1973 | Grueber | 30/287 |
| 4,205,440 | 6/1980 | Morgan | 30/287 |
| 4,467,524 | 8/1984 | Ruff et al. | 30/289 |

*Primary Examiner*—Jimmy C. Peters

*Attorney, Agent, or Firm*—Arne I. Fors; Robert F. Delbridge

[57] ABSTRACT

A wallpaper trimming tool for cutting wall coverings on outer wall corners. The tool comprises a pair of rectangular blocks secured together with a pair of cutting blades spaced from an extension of one block by an intermediate sheet of shim material, cutting edges of said blades extending co-planar with the ends of the blocks.

3 Claims, 3 Drawing Figures

WALLPAPER TRIMMER

BACKGROUND OF THE INVENTION

This invention relates to a wallpaper trimming tool and, more particularly, relates to a cutting device for trimming wallpaper and the like wall coverings on outer wall corners.

Hand tools for the trimming and cutting of wall coverings such as wallpaper are well-known. U.S. Pat. Nos. 2,473,551; 2,889,623; 3,500,540 and 4,077,124 discloses various embodiments of wallpaper cutting and trimming hand tools. A common problem in known cutting tools is the difficulty in maintaining a straight cut relative to a wall corner. In addition, the depth of cut and recess of cut edge from a wall corner often are difficult to control and the completion of a cut on a wall corner from the floor to the ceiling often is difficult to accomplish. The cut edges of wall coverings such as wallpaper thus often are susceptible to damage due to separation and fraying necessitating the use of protective plastic wall corners.

STATEMENT OF INVENTION

The cutting tool of the present invention substantially overcomes the shortcomings in conventional hand tools in that it permits completion of a recessed cut a uniform distance from the wall corner from floor to ceiling.

In its broad aspect, the cutting tool of the invention for trimming wall coverings on outer wall corners comprises the combination of a first block having a planar surface on one edge and a planar surface on one side thereof, said first block having opposite end walls intersecting said planar edge surface at an angle of not greater than 90° , a cutting blade adjacent said first block planar side surface at each end wall each having a cutting edge extending beyond the plane of the planar edge surface, said cutting edges extending substantially coplanar with the respective end walls, a sheet of shim material of predetermined thickness abutting the planar side surface of the first block, and a second block having a planar surface on one side thereof for securement adjacent the sheet of shim material, said second block having an edge extending beyond the planar edge of the first block to provide a right-angled guide surface for slideable engagement with an outer wall corner.

BRIEF DESCRIPTION OF THE DRAWING

The invention will now be described with reference to the accompanying drawing, in which.

DESCRIPTION OF THE PREFERRED EMBODIMENT

Figure 1:
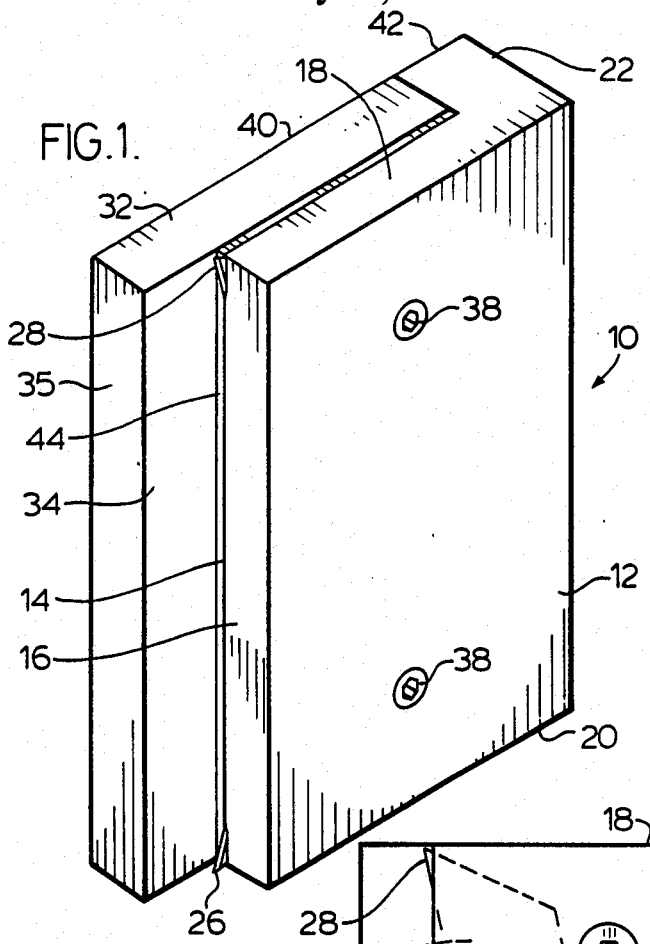
FIG. 1 is a perspective view of the cutting tool of the present invention.

With reference now to the drawings, the cutting tool of the invention generally designated by numeral 10 consists of a first block 12 having a planar interior surface 14 and a planar edge surface 16. Block 12 preferably is rectangular in shape having opposite end walls 18, 20 defining an angle with planar edge 14 of not greater than 90°. The rear edge of block 12 has a shoulder upset

22 extending the length of block 12 for reasons which will become apparent as the description proceeds.

Figure 2:
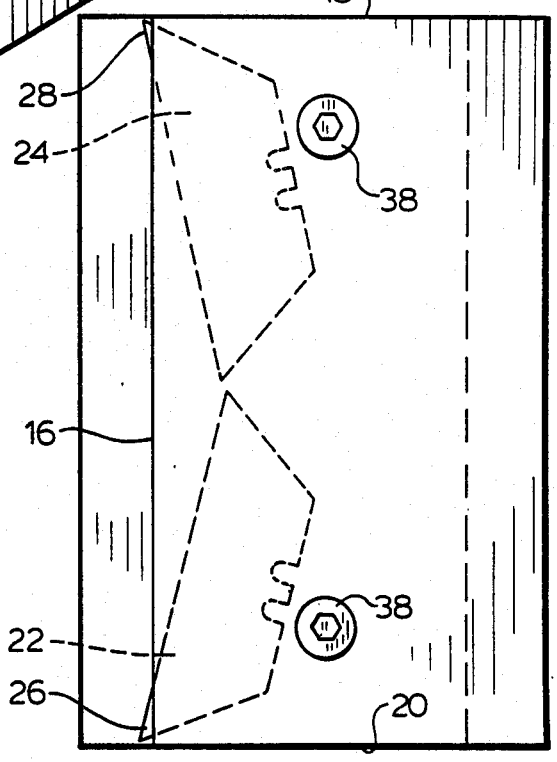
FIG. 2 is a side elevation view of said cutting device shown in FIG. 1.
Figure 3:
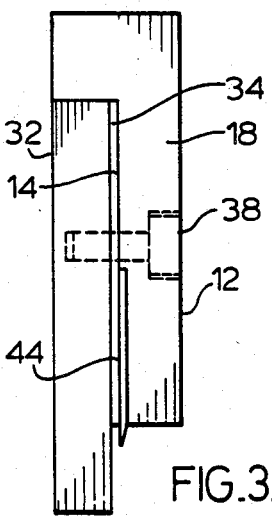
FIG. 3 is a top end view, as shown in FIG. 2, of said tool.

A pair of cutting blades 24, 22 are seated adjacent the inner planar surface 14 of block 12 such that cutting edges 26, 28 extending beyond the plane of planar edge 16 are substantially co-planar with surface 14. Cutting blades 24, 26 preferably have triangular cutting edges 26, 28 such as provided by STANLEY (TM) blades No. 1992. Cutting edges 26, 28 extend beyond the plane of planar edge 16 a distance sufficient to sever a wall covering such as wallpaper while extending lengthwise of the tool 10 substantially co-planar with end surfaces 18, 20, as shown most clearly in FIG. 2.

A second block 32, preferably of rectangular shape having a length equal to the length of block 12, has a planar surface 34 adapted to abut a planar surface of a sheet of shim material 44 disposed between block 12 and block 32. Block 32 and shim material 44 have a total thickness substantially equal to the thickness of shoulder 22 of block 12 such that securement of block 32 to block 12 by means of connecting means, such as screws 38, results in the external surface 40 of block 32 being substantially co-planar with the external surface 42 of shoulder 22.

Shim material 44 uniformly spaces cutting edges 26, 28 laterally from planar surface 34 of extension 35 of block 32 and thus functions as a guage distance during use of the said cutting tool.

The cutting edges 26, 28 thus sever the wall covering the predetermined gauge distance back from the wall corner edge to avoid separation, fraying or the like damage to the recessed edge of the wall covering. It will be understood that the gauge distance can be readily modified by varying the thickness of the shim or by adding an additional shim to a first shim.

Blocks 12, 32 and sheet 30 may be formed from a plastics material, aluminum alloy or wood.

In use, tool 10 is applied to an outer wall corner having a wall covering such as wallpaper such that right-angled planar surfaces 16, 34 receive the wall corner in sliding engagement. The cutting tool is moved longitudinally up or down the said wall corner between the ceiling and floor such that cutting edges 26, 28 uniformly spaced a pre-determined gauge distance from planar surface 34 will sever and trim said wall covering a recessed distance from the wall corner. Cutting blades 22, 24 can be conveniently replaced by loosening of screws 38 and disassembly of block 12 from sheet material 44.

It will be understood of course that modifications can be made in the embodiments of the invention illustrated and described herein without departing from the scope and purview of the invention as defined by the appended claims.

What I claim as new and desire to protect by Letters Patent of the United States is:

1. A cutting device for trimming wall coverings on outer wall corners comprising, in combination, a first block having a planar surface on one edge and a planar surface on one side thereof, said first block having opposite end walls intersecting said planar edge surface at an angle of not greater than 90°; a cutting blade adjacent said first block planar side surface at each end wall, each having a cutting edge extending beyond the plane of the planar edge surface, said cutting edges extending substantially co-planar with the respective end walls; a sheet of shim material of predetermined gauge thickness abutting the planar side surface of the first block; and a second block having a planar surface on one side thereof for securement adjacent the sheet of shim material, said second block having an edge extending beyond the planar edge of the first block to provide a right-angled guide surface for slideable engagement with an outer wall corner.

2. A cutting tool as claimed in claim 1 in which said cutting blades each have a triangular cutting edge.

3. A cutting tool as claimed in claim 2 in which said blocks are formed of a material selected from plastics, aluminum alloy or wood.

* * * * *